US008555644B2

(12) United States Patent
Wang

(10) Patent No.: US 8,555,644 B2
(45) Date of Patent: Oct. 15, 2013

(54) FULL STEAM-DRIVEN INTERNAL-COMBUSTION ENGINE USING EXTENDED GAS SUPPLY SYSTEM

(76) Inventor: Dundun Wang, Shenzhen (CN)

( * ) Notice: Subject to any disclaimer, the term of this patent is extended or adjusted under 35 U.S.C. 154(b) by 83 days.

(21) Appl. No.: 13/265,114

(22) PCT Filed: Jun. 28, 2010

(86) PCT No.: PCT/CN2010/000967

§ 371 (c)(1),
(2), (4) Date: Oct. 18, 2011

(87) PCT Pub. No.: WO2011/011963

PCT Pub. Date: Feb. 3, 2011

(65) Prior Publication Data

US 2012/0117971 A1 May 17, 2012

(30) Foreign Application Priority Data

Jul. 29, 2009 (CN) ..... 2009 1 0109144

(51) Int. Cl.
*F01B 29/04* (2006.01)

(52) U.S. Cl.
USPC ..... 60/712

(58) Field of Classification Search
USPC ..... 60/670, 712
See application file for complete search history.

(56) References Cited

U.S. PATENT DOCUMENTS 5,709,088 A 1/1998 Acaster

FOREIGN PATENT DOCUMENTS

| | | | |
|---|---|---|---|
| CN | 1793629 | A | 6/2006 |
| CN | 101173631 | A | 5/2008 |
| CN | 101619675 | A | 1/2010 |
| JP | 8177521 | A | 7/1996 |

*Primary Examiner* — Kenneth Bomberg
*Assistant Examiner* — Philip Eklem
(74) *Attorney, Agent, or Firm* — Morris Manning & Martin LLP; Tim Tingkang Xia, Esq.

(57) ABSTRACT

A full steam-driven internal combustion engine includes a mechanical power system, a combustion system and an air supply system. The mechanical power system includes a turbine and a turbine shaft. The combustion system includes a left main cylinder and a left auxiliary cylinder, and a right main cylinder and a right auxiliary cylinder which are arranged at the left or the right side of the turbine shaft respectively. The air supply system includes a high pressure air bottle connected by a high pressure air pipe and an air compressor. A left high pressure air valve and a right high pressure air valve are arranged on the both sides of the high pressure air bottle respectively and these high pressure air valves are communicated with the left or the right main cylinder by the high pressure air pipe and intake valves respectively.

4 Claims, 1 Drawing Sheet

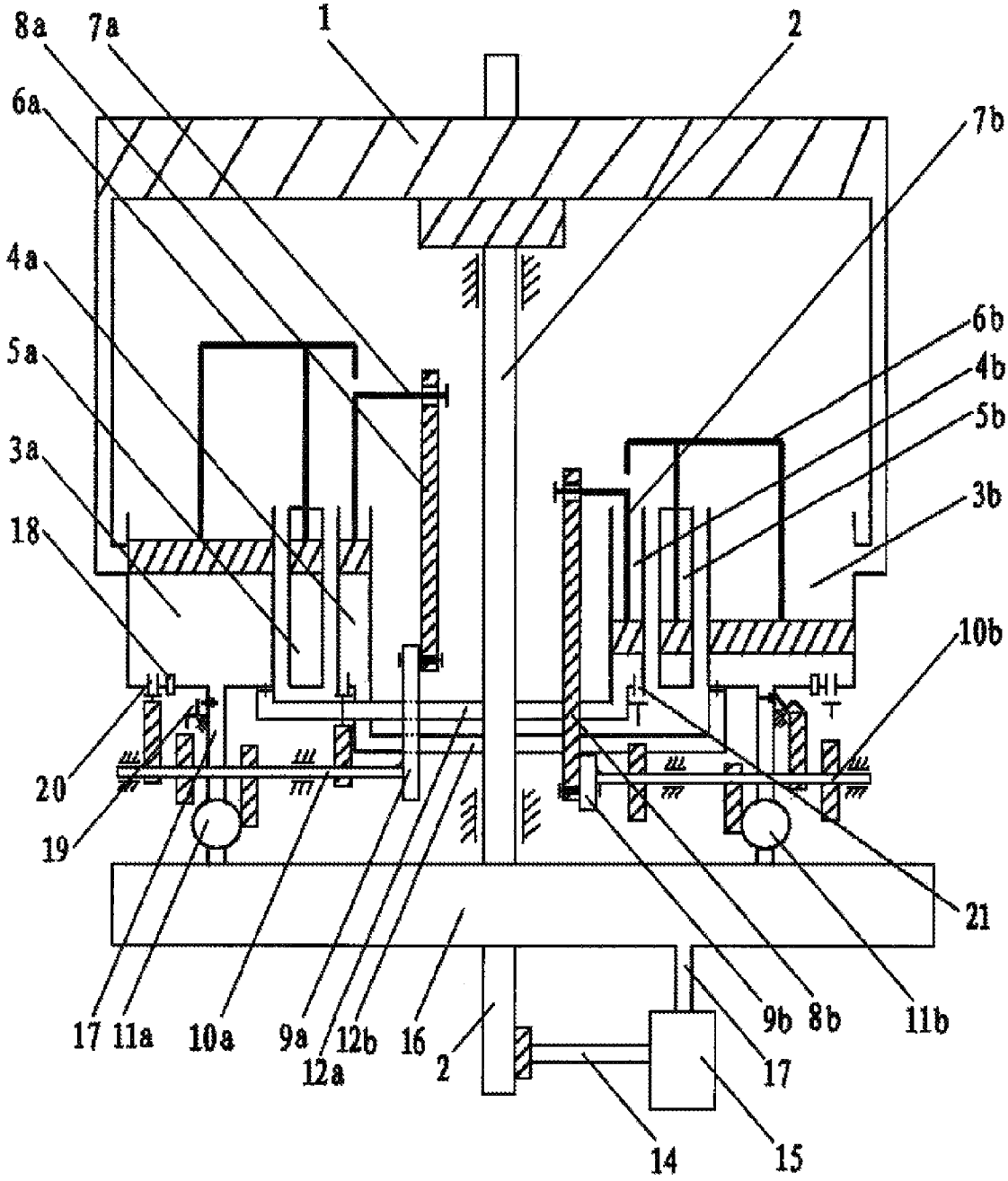
8a
7a
1
2
6a
7b
4a
6b
5a
4b
5b
3a
3b
18
10b
20
19
21
17
11a
10a
9a
12b
16
2
9b
8b
11b
12a
17
14
15

FULL STEAM-DRIVEN INTERNAL-COMBUSTION ENGINE USING EXTENDED GAS SUPPLY SYSTEM

CROSS-REFERENCE TO RELATED APPLICATIONS

This application claims priorities of Chinese Patent Application No. 200910109144.X, filed on Jul. 29, 2009, entitled "Full Steam-Driven Internal-Combustion Engine", by Dundun Wang, the disclosure of which is incorporated herein by reference in its entirety.

FIELD OF THE INVENTION

The invention relates to an internal combustion engine, and in particular relates to a full steam-driven internal-combustion engine using an extended gas supply system.

BACKGROUND OF THE INVENTION

China Invention Patent No. ZL200510100647.1, applied on Oct. 28, 2005, discloses a full steam-driven internal-combustion engine including a combustion system and a mechanical power system. The mechanical power system includes a turbine wheel and a turbine shaft. The combustion system mainly includes left/right main cylinders and two auxiliary devices, and the auxiliary devices are composed of left/right auxiliary cylinders, huge springs, high-strength levers and high-pressure gas pipes, respectively. The left main cylinder is communicated with the right auxiliary cylinder via the high-pressure gas pipe, and the right main cylinder is communicated with the left auxiliary cylinder via the high-pressure gas pipe. The main cylinder includes a housing and a high-pressure nozzle, wherein the high-pressure nozzle disposed beside the top portion of the housing is communicated with the turbine wheel of the mechanical power system. A coordination card is utilized to connect the top end of the piston of the cylinder to the high-strength lever, and the high-strength lever is connected to the huge spring. The huge spring is fixed by a steel frame, and the high-strength lever is further connected to the piston of the auxiliary cylinder. This full steam-driven internal-combustion engine includes the internal-combustion engine utilized for performing combustion and the gas turbine utilized for producing mechanical power, thereby obtaining high combustion efficiency and reliability, simple structural configuration and operation, low manufacturing cost, and convenience for maintenance. However, the coordination cards connected between the piston of the cylinder and the lever is unstable, the oversized huge springs tend to be deteriorated from fatigue and aging, the positions of the huge springs cause the overlength of the high-pressure nozzles, and no gas supply system is provided. Therefore, this full steam-driven internal-combustion engine is unsuitable for being utilized in large-scale production and different applications.

BRIEF SUMMARY OF THE INVENTION

In view of the deficiency of the above-described full steam-driven internal-combustion engine, the main purpose of the invention is to provide a full steam-driven internal-combustion engine using an extended gas supply system, characterized with an improved structural configuration, an extended gas supply system, and a reliable operation process and an enhanced practicability.

To achieve the purposes above, the invention is adopted with the technology projects as follows. A full steam-driven internal-combustion engine using an extended gas supply system of the invention comprises a mechanical power system and a combustion system. The mechanical power system includes a turbine wheel and a turbine shaft used for the turbine wheel. The combustion system includes a left main cylinder and a left auxiliary cylinder which are arranged at a left side of the turbine shaft and a right main cylinder and a right auxiliary cylinder which are arranged at a right side of the turbine shaft, wherein the left main cylinder is communicated with the right auxiliary cylinder via a left high-pressure gas pipe, the right main cylinder is communicated with the left auxiliary cylinder via a right high-pressure gas pipe, and high-pressure nozzles connectively communicated with the turbine wheel of the mechanical power system are disposed on the left/right main cylinders of the combustion system. It is characterized in that the full steam-driven internal-combustion engine further comprises a gas supply system including a high-pressure gas bottle and an air compressor connected to the high-pressure gas bottle via a high-pressure gas pipe, a left high-pressure gas valve and a right high-pressure gas valve respectively disposed on both sides of the high-pressure gas bottle are respectively communicated with the left main cylinder and the left auxiliary cylinder of the combustion system via a high-pressure gas pipe and an intake valves. Further, each of the left/right auxiliary cylinders of the combustion system includes an outer housing and a piston, the housings of the left/right auxiliary cylinders have bottom portions respectively disposed with an exhaust valve, and the pistons of the left/right auxiliary cylinders have top portions respectively connected to a lever "B"; two air-compressive flexible devices are respectively disposed in between the left main cylinder and the left auxiliary cylinder and in between the right main cylinder and the right auxiliary cylinder, and each of the air-compressive flexible devices includes an outer housing and a piston; the pistons of the left/right main cylinders are fixedly connected to the pistons of the air-compressive flexible devices via levers "A" respectively, and each of the levers "A" has an extension part arranged above the lever "B"; a linkage "A" includes a top end hinged to the lever "B" and a lower end hinged to an end of a linkage "B"; and the left/right main cylinders have bottom ends respectively disposed with an intake valve, an exhaust valve and an electric sparkling plug. Further, two cam spindles are respectively disposed in between the left main cylinder and the high-pressure gas bottle and in between the right main cylinder and the high-pressure gas bottle, and each of the cam spindles includes four cams, wherein the cams of the two cam spindles are respectively corresponding to the intake valves and the exhaust valves of the left/right main cylinders of the combustion system, the left/right high-pressure gas valves of the gas supply system, and the exhaust valves of the left/right auxiliary cylinders of the combustion system, and the two cam spindles have ends fixedly connected to the linkages "B", respectively.

The turbine shaft of the mechanical power system includes a lower end extended to the high-pressure gas bottle of the gas supply system and connected to the air compressor by a transmission shaft.

The air-compressive flexible devices, the left/right main cylinders, and the left/right auxiliary cylinders are juxtaposedly arranged in parallel.

The high-pressure nozzles are respectively disposed in the vicinity of side surfaces of top portions of the outer housings of the left/right main cylinders, and one-way flexible valves are disposed in the left/right high-pressure gas pipes, respectively.

On the basis of the conventional skills, the full steam-driven internal-combustion engine using an extended gas supply system of the invention adopts structures enables an extension part of a lever "A" to be positioned above a lever "B" instead of a conventional coordination card, and the structures that are matched, but not connected ensure that the whole structure is simple and reliable; in addition, a huge spring in the prior art is substituted by a compressed-air spring device, thereby the service life is long, and the volume is small; and the gas supply system comprising a high-pressure gas bottle and an air compressor is also additionally arranged. The invention enables the whole internal-combustion engine to be convenient for large-scale production due to the improvement and has better practicability and reliability.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein:

FIG. 1 is a schematic view of the structure of the invention.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Referring to FIG. 1, a full steam-driven internal-combustion engine using an extended gas supply system comprises a mechanical power system, a combustion system and a gas supply system.

1. Combustion System

In the combustion system, a high-pressure gas produced by deflagrating a fuel air mixture is ejected from a high-pressure nozzle to form a high speed power source. The combustion system includes two main cylinders and an auxiliary device. The two main cylinders, a left main cylinder 3*a* and a right main cylinder 3*b*, are interactively operated. That is, when the left main cylinder 3*a* does work, i.e., when high-pressure hot gas clusters produced by deflagrating the fuel air mixture in the left main cylinder 3*a* are ejected from the pressure nozzle at a high speed, a gas sucking process is completed by the right main cylinder 3*b*.

Each of the left/right main cylinders 3*a*/3*b* includes an assembly of a cylinder housing and a piston. In the left main cylinder 3*a*, an intake valves 19, an exhaust valve 20, an electric sparkling plug 18, and a left high-pressure gas valve 11*a* communicated with a high-pressure gas pipe 17 are disposed on a bottom portion of the cylinder housing. In the right main cylinder 3*b*, an intake valves 19, an exhaust valve 20, an electric sparkling plug 18, and a right high-pressure gas valve 11*b* communicated with a high-pressure gas pipe 17 are disposed on a bottom portion of the cylinder housing. Two high-pressure nozzles are respectively disposed in the vicinity of side surfaces of top portions of the outer housings of the left/right main cylinders 3*a*/3*b*. The left/right main cylinders 3*a*/3*b* have the same structure.

The operation of the left/right main cylinders 3*a*/3*b* comprises the following steps.

i) The piston is moved from the bottom portion to the top end of the cylinder, and the fuel air mixture is sucked into the cylinder via the intake valves 19.

ii) The piston of the main cylinder is stopped to seal the high-pressure nozzle when the piston is moved to the position of the high-pressure nozzle thereof.

iii) The fuel air mixture located in the main cylinder is ignited by the electric sparkling plug 18.

iv) The piston is upwardly pushed by the high-pressure gas produced by deflagrating the fuel air mixture; meanwhile, the high-pressure gas is accelerately ejected from the high-pressure nozzle.

v) When the high-pressure gas mostly is ejected from the high-pressure nozzle, the main cylinder is filled with the waste gas. Then, the piston begins to downwardly move from the top end of the cylinder to expel the waste gas therein through the exhaust valve 20. A working process of the cylinder is completed until the piston is moved to the bottom portion of the cylinder to expel the waste gas in the cylinder.

The auxiliary device of the left/right main cylinders 3*a*/3*b* comprises left/right air-compressive flexible devices 5*a*/5*b*, a left auxiliary cylinder 4*a*, a right auxiliary cylinder 4*b*, left/right levers "A" 6*a*/6*b*, left/right levers "B" 7*a*/7*b*, a left high-pressure gas pipe 12*a*, a right high-pressure gas pipe 12*b*, left/right linkages "A" 8*a*/8*b*, left/right linkages "B" 9*a*/9*b*, and left/right cam spindles 10*a*/10*b*. With the left high-pressure gas pipe 12*a*, the bottom portion of the left main cylinder 3*a* is connected to the bottom portion of the right auxiliary cylinder 4*b* which is belong to the right main cylinder 3*b*. With the right high-pressure gas pipe 12*b*, the bottom portion of the right main cylinder 3*b* is connected to the bottom portion of the left auxiliary cylinder 4*a* which is belong to the left main cylinder 3*a*. Two one-way flexible valves are respectively disposed in the left/right high-pressure gas pipes 12*a*/12*b*.

The left/right air-compressive flexible devices 5*a*/5*b* of the invention have the similar functions as that of the huge spring of the conventional full steam-driven internal-combustion engine. In the working principle of the left/right air-compressive flexible devices 5*a*/5*b*, the elasticity is produced by compressing the air. The left/right air-compressive flexible devices 5*a*/5*b*, arranged substantially being parallel to the left/right main cylinders 3*a*/3*b* and the left/right auxiliary cylinders 4*a*/4*b*, are respectively disposed in between the left main cylinder 3*a* and the left auxiliary cylinder 4*a* and in between the right main cylinder 3*b* and the right auxiliary cylinder 4*b*. Herewith, it is understood that the air-compressive flexible device has a small, a high elasticity produced, and a reliable and firm structure.

The left/right air-compressive flexible devices 5*a*/5*b* have the same structure, and each of which comprises an outer housing and a piston, wherein the piston includes a top end connected to the left/right levers "A" 6*a*/6*b*. The left/right auxiliary cylinders 4*a*/4*b* have the same structure, and each of which comprises an outer housing and a piston. The housings of the left/right auxiliary cylinders 4*a*/4*b* have bottom portions respectively disposed with an exhaust valve 21, and the pistons of the left/right auxiliary cylinders 4*a*/4*b* have top portions respectively connected to the left/right levers "B" 7*a*/7*b*. The pistons of the left/right main cylinders 3*a*/3*b* are fixedly connected to the pistons of the left/right air-compressive flexible devices 5*a*/5*b* via the left/right levers "A" 6*a*/6*b*, respectively. The top portions of the pistons of the left/right auxiliary cylinders 4*a*/4*b* are fixedly connected to the left/right levers "B" 7*a*/7*b*, respectively.

The left/right levers "A" 6*a*/6*b* and the left/right levers "B" 7*a*/7*b* are disconnected to each other, respectively, logically designed to replace a coordination card in the conventional combustion system. The left/right linkages "A" 8*a*/8*b* have first ends, which are hinged to the top ends of the left/right levers "B" 7*a*/7*b* disposed on the pistons of the left/right auxiliary cylinders 4*a*/4*b* via two metallic pins, respectively, wherein an angle formed between the linkage "A" and the lever "B" can be changed. The left/right linkages "A" 8*a*/8*b* have second ends, which are hinged to the ends of the linkages "B" 9*a*/9*b* via two metallic pins, respectively, wherein an angle formed between the linkage "A" and the linkage "B" can be changed.

The linkages "B" 9*a*/9*b* have ends fixedly connected to the ends of the left/right cam spindles 10*a*/10*b*, respectively. Each of the left/right cam spindles 10*a*/10*b* includes four cams, corresponding to the intake valves 19 and the exhaust valves 20 of the left/right main cylinders 3*a*/3*b* of the combustion system, the left/right high-pressure gas valves 11*a*/11*b* of the gas supply system, and the exhaust valves 21 of the left/right auxiliary cylinders 4*a*/4*b* of the combustion system, respectively. The left/right cam spindles 10*a*/10*b* have ends fixedly connected to the linkages "B", respectively. When the left/right cam spindles 10*a*/10*b* are rotated, the cams of the left/right cam spindles 10*a*/10*b*, adequately and sequentially, respectively drive the intake valves 19 and the exhaust valves 20 of the left/right main cylinders 3*a*/3*b* of the combustion system, the left/right high-pressure gas valves 11*a*/11*b* of the gas supply system, and the exhaust valves 21 of the left/right auxiliary cylinders 4*a*/4*b* of the combustion system, for performing opening and closing processes. The other parts of the left/right cam spindles 10*a*/10*b* are relatively fixedly positioned by steel frames and bearings.

The working principle of the auxiliary system is described as follows.

(1). When the fuel air mixture located inside the left main cylinder 3*a* is deflagrated, the piston of the left main cylinder 3*a* leads the piston of the left air-compressive flexible device 5*a* to lift or upwardly move via the left lever "A" 6*a*, so that the left lever "A" 6*a* is disconnected from the left lever "B" 7*a*, i.e., the contact relationship between the left lever "A" 6*a* and the left lever "B" 7*a* is terminated.

(2). When the high-pressure gas located inside the left main cylinder 3*a* is partially transmitted to the right auxiliary cylinder 4*b* via the left high-pressure gas pipe 12*a*, the piston of the right auxiliary cylinder 4*b* is upwardly moved. With the one-way flexible valves disposed in the left/right high-pressure gas pipes 12*a*/12*b*, it is noted that the gas flows reaching predetermined pressure are unidirectional flows traveling from the left/right main cylinders 3*a*/3*b* toward the right/left auxiliary cylinders 4*b*/4*a*, respectively.

(3). When the piston of the right auxiliary cylinder 4*b* leads the piston of the right main cylinder 3*b* and the piston of the right air-compressive flexible device 5*b* to lift or upwardly move via the right lever "B" 7*b* and the right lever "A" 6*b*, the right main cylinder 3*b* sucks the fuel air mixture therein.

(4). With the right linkage "A" 8*b* and the right linkage "B" 9*b* to be leaded by the piston of the right auxiliary cylinder 4*b* and the right lever "B" 7*b*, the right cam spindle 10*b* is rotated to drive the cams to simultaneously open the intake valves 19 and the right high pressure air valve 11*b* of the right main cylinder 3*b*.

(5). When the high-pressure gas located inside the left main cylinder 3*a* is almost ejected, the piston of the left air-compressive flexible device 5*a* simultaneously pushes the piston of the left main cylinder 3*a* and the piston of the left auxiliary cylinder 4*a* via the left lever "A" 6*a* and the left lever "B" 7*a* to downwardly move.

(6). The left air-compressive flexible device 5*a* drives the left cam spindle 10*a* to rotate via the left lever "A" 6*a*, the left lever "B" 7*a*, the left linkage "A" 8*a* and the left linkage "B" 9*a*, so that the cams of the left cam spindle 10*a* drive the exhaust valve 20 of the left main cylinder 3*a* and the exhaust valve 21 of the left auxiliary cylinder 4*a* for opening, respectively.

(7). The waste gases located in the piston of the left main cylinder 3*a* and the piston of the left auxiliary cylinder 4*a* are expelled when the piston of the left main cylinder 3*a* and the piston of the left auxiliary cylinder 4*a* are moved to the bottom portions thereof. The right main cylinder 3*b* is filled with the fuel air mixture when the piston of right main cylinder 3*b* is moved to the position of the right high-pressure nozzle thereof (8). When the fuel air mixture located in the right main cylinder 3*b* is deflagrated, the piston of the right main cylinder 3*b* leads the piston of the right air-compressive flexible device 5*b* to upwardly move via the right lever "A" 6*b*, so that the right lever "A" 6*b* is disconnected from the right lever "B" 7*b*, i.e., the contact relationship between the right lever "A" 6*b* and the right lever "B" 7*b* is terminated.

(9). When the high-pressure gas located inside the right main cylinder 3*b* is partially transmitted to the left auxiliary cylinder 4*a* via the right high-pressure gas pipe 12*b*, the piston of the right high-pressure gas pipe 12*b* is upwardly moved.

(10). When the piston of the left auxiliary cylinder 4*a* leads the piston of the left main cylinder 3*a* and the piston of the left air-compressive flexible device 5*a* to upwardly move via the left lever "A" 6*a* and the left lever "B" 7*a*, the left main cylinder 3*a* sucks the fuel air mixture therein.

(11). With the left linkage "A" 8*a* and the left linkage "B" 9*a* to be leaded by the piston of the left auxiliary cylinder 4*a* and the left lever "B" 7*a*, the left cam spindle 10*a* is rotated to drive the cams thereof to simultaneously open the intake valves 19 of the left main cylinder 3*a* and the left high-pressure gas valve 11*a*.

(12). When the high-pressure gas mostly is ejected from the right main cylinder 3*b*, the piston of the right air-compressive flexible device 5*b* simultaneously pushes the piston of the right main cylinder 3*b* and the piston of the right auxiliary cylinder 4*b* to downwardly move via the right lever "A" 6*b* and the right lever "B" 7*b*.

(13). The piston of the right air-compressive flexible device 5*b* drives the right cam spindle 10*b* to rotate via the right lever "A" 6*b*, the right lever "B" 7*b*, the right linkage "A" 8*b* and the right linkage "B" 9*b*, so that the cams of the right cam spindle 10*b* drive the exhaust valve 20 of the right main cylinder 3*b* and the exhaust valve 21 of the right auxiliary cylinder 4*b* for opening, respectively.

(14). The waste gases located in the left main cylinder 3*a* and the left auxiliary cylinder 4*a* are respectively expelled when the piston of the left main cylinder 3*a* and the piston of the left auxiliary cylinder 4*a* are moved to the bottom portions thereof. The right main cylinder 3*b* is filled with the fuel air mixture when the piston of right main cylinder 3*b* is moved to the position of the right high-pressure nozzle thereof.

(15). When the piston of the left main cylinder 3*a* and the piston of the right main cylinder 3*b* continuously and alternatively do works, the auxiliary system of the left main cylinder 3*a* and the auxiliary system of the right main cylinder 3*b* repeat the above-described movements and processes.

The auxiliary systems are utilized to assist the left/right main cylinders 3*a*/3*b* in actuating to each other when the left/right main cylinders 3*a*/3*b* do work, respectively. The left main cylinder 3*a*, the left auxiliary cylinder 4*a*, the left air-compressive flexible device 5*a*, the right main cylinder 3*b*, the right auxiliary cylinder 4*b* and the right air-compressive flexible devices 5*b* are fixed by steel frames.

2. Mechanical Power System

With the mechanical power system, the high-pressure and high-speed hot gas flows, produced by the left/right main cylinders 3*a*/3*b* and ejected from the high-pressure nozzles, are converted into mechanical rotation. The mechanical power system includes a large-diameter turbine wheel 1 and a turbine shaft 2 used for the turbine wheel 1 and longitudinally extended to the bottom of the internal-combustion engine. The turbine wheel 1 is rotatably fixed by a steel frame and a bearing.

The working principle of the turbine wheel 1 is that the turbine wheel 1 is rotated by propelling turbine blades when the high-speed ad high-pressure gas flow is acted on the turbine blades. The turbine shaft 2 driven by the turbine wheel 1 continuously outputs a mechanical work to drive an air compressor 15 of the gas supply system.

3. Gas Supply System

With the gas supply system, an oxygen gas is sufficiently supplied to the left/right main cylinders 3*a*/3*b* for combustion. The gas supply system comprises the air compressor 15, a transmission shaft 14 connected to the air compressor 15 and turbine shaft 2 of the mechanical power system, a high-pressure gas pipe 17, and the left/right high-pressure gas valves 11*a*/11*b*.

The working principles of the components of the gas supply system are described as follows. The air compressor 15 utilizes the continuous rotation of the transmission shaft 14 as a power for converting the high-pressure air. The transmission shaft 14 is utilized to transmit the energy from the turbine shaft 2 to drive the air compressor 15. The high-pressure gas bottle 16 is utilized to store and sufficiently supply a high-pressure air to the left/right main cylinders 3*a*/3*b* for combustion. When the left/right cam spindles 10*a*/10*b* are rotated, the cams of the left/right cam spindles 10*a*/10*b* adequately push the left/right high-pressure gas valves 11*a*/11*b* for opening or closing, adequately enabling the high-pressure gas to enter the left/right main cylinders 3*a*/3*b* via the left/right high-pressure gas valves 11*a*/11*b* and the intake valves 19.

The high-pressure gas pipe 17 is a high-pressure gas passage utilized to connect the air compressor 15, the high-pressure gas bottle 16, the left/right high-pressure gas valves 11*a*/11*b*, and the left/right main cylinders 3*a*/3*b*. The transmission shaft 14 is rotatably fixed by a steel frame and a bearing. The air compressor 15, the high-pressure gas bottle 16, and the left/right high-pressure gas valves 11*a*/11*b* are fixed by steel frames.

What is claimed is:

1. A full steam-driven internal-combustion engine using an extended gas supply system, comprising a mechanical power system and a combustion system, the mechanical power system including a turbine wheel and a turbine shaft used for the turbine wheel, the combustion system including a left main cylinder and a left auxiliary cylinder which are arranged at a left side of the turbine shaft and a right main cylinder and a right auxiliary cylinder which are arranged at a right side of the turbine shaft, wherein the left main cylinder is communicated with the right auxiliary cylinder via a left high-pressure gas pipe, the right main cylinder is communicated with the left auxiliary cylinder via a right high-pressure gas pipe, and high-pressure nozzles connectively communicated with the turbine wheel of the mechanical power system are disposed on the left/right main cylinders of the combustion system, characterized in that:

(a) the full steam-driven internal-combustion engine further comprises a gas supply system including a high-pressure gas bottle and an air compressor connected to the high-pressure gas bottle via a high-pressure gas pipe, a left high-pressure gas valve and a right high-pressure gas valve respectively disposed on both sides of the high-pressure gas bottle are respectively communicated with the left main cylinder and the left auxiliary cylinder of the combustion system via another high-pressure gas pipe and an intake valves;

(b) each of the left/right auxiliary cylinders of the combustion system includes an outer housing and a piston, the housings of the left/right auxiliary cylinders have bottom portions respectively disposed with an exhaust valve, and the pistons of the left/right auxiliary cylinders have top portions respectively connected to a lever "B"; two air-compressive flexible devices are respectively disposed in between the left main cylinder and the left auxiliary cylinder and in between the right main cylinder and the right auxiliary cylinder, and each of the air-compressive flexible devices includes an outer housing and a piston; the pistons of the left/right main cylinders are fixedly connected to the pistons of the air-compressive flexible devices via levers "A" respectively, and each of the levers "A" has an extension part arranged above the lever "B"; a linkage "A" includes a top end hinged to the lever "B" and a lower end hinged to an end of a linkage "B"; the left/right main cylinders have bottom ends respectively disposed with an intake valve, an exhaust valve and an electric sparkling plug;

(c) two cam spindles are respectively disposed in between the left main cylinder and the high-pressure gas bottle and in between the right main cylinder and the high-pressure gas bottle, and each of the cam spindles includes four cams, wherein the cams of the two cam spindles are respectively corresponding to the intake valves and the exhaust valves of the left/right main cylinders of the combustion system, the left/right high-pressure gas valves of the gas supply system, and the exhaust valves of the left/right auxiliary cylinders of the combustion system, and the two cam spindles have ends fixedly connected to the linkages "B", respectively.

2. The full steam-driven internal-combustion engine using the extended gas supply system as claimed in claim 1, characterized in that the turbine shaft of the mechanical power system includes a lower end extended to the high-pressure gas bottle of the gas supply system and connected to the air compressor by a transmission shaft.

3. The full steam-driven internal-combustion engine using the extended gas supply system as claimed in claim 1, characterized in that the air-compressive flexible devices, the left/right main cylinders, and the left/right auxiliary cylinders are juxtaposedly arranged in parallel.

4. The full steam-driven internal-combustion engine using the extended gas supply system as claimed in claim 1, characterized in that the high-pressure nozzles are respectively disposed in the vicinity of side surfaces of top portions of the outer housings of the left/right main cylinders, and one-way flexible valves are disposed in the left/right high-pressure gas pipes, respectively.

* * * * *